US005109622A

United States Patent [19]

Echeberria

[11] Patent Number: 5,109,622

[45] Date of Patent: May 5, 1992

[54] RIFLE

[75] Inventor: Julian Echeberria, Eibar, Spain

[73] Assignee: Dikar, S. Coop, LTDA., Bergara, Spain

[21] Appl. No.: 629,640

[22] Filed: Dec. 21, 1990

[30] Foreign Application Priority Data

Dec. 26, 1989 [ES] Spain ..... 8904357

[51] Int. Cl.[5] ..... F41A 19/13; F41A 17/30

[52] U.S. Cl. ..... 42/69.02; 42/51; 42/70.04

[58] Field of Search ..... 42/51, 69.02, 70.01, 42/70.04, 70.05, 70.06, 70.08, 96

[56] References Cited

U.S. PATENT DOCUMENTS

| | | | |
|---|---|---|---|
| 269,152 | 12/1882 | Zundorff | 42/51 |
| 4,700,499 | 10/1987 | Knight | 42/51 |
| 4,715,139 | 12/1987 | Rodney, Jr. | 42/51 |

*Primary Examiner*—Charles T. Jordan
*Attorney, Agent, or Firm*—Browdy and Neimark

[57] ABSTRACT

A rifle which is comprised of a barrel, an internal striker, a firing device connected to the striker, and a base which includes the butt and the lower part of the weapon. The striker receives a spring in a hole, which rests in a rear plug of the barrel. The firing mechanism is connected to a bolt lever and safety which inserts transversely therein. The firing mechanism is at the same time a safety, since when the weapon is loaded it is in non-firing position, and the outside activation of the safety catch is necessary to make the discharge.

8 Claims, 9 Drawing Sheets

RIFLE

BACKGROUND OF INVENTION

This specification refers to hunting rifles of the type known as muzzle loaders.

DESCRIPTION OF PRIOR ART

In this field exceptional importance is bestowed on the safety factor so that undesired firings are not caused by unforeseen actions. Within the field of this category of rifles, several rifles based on cylindrical strikers which slide through the inside of the back portion of the barrel are known, which are held tight by springs from their end in order for the forward end to strike on the primer cap to produce the spark that causes the firing.

Normally these mechanisms are of great simplicity and so must be executed with precision and equipped with safety devices which are reliable, which is usually not the case.

SUMMARY OF THE INVENTION

One object of this invention is the creation of a mechanism for a rifle which is equipped with two safeties, of which one is manual on the edge of the striker and the other is automatic, inside the firing mechanisms, this latter one needing to be disconnected in order to produce the impact on the primer.

Another object of the invention is the creation of protection from the firing chamber, which avoids the classic problems of the upward discharge of gases, at the same time achieving a lower outlet for such gases.

Another object of the invention is the creation of a barrel which is a single part of the weapon that includes all the mechanisms of same and to which the butt is fitted.

In order to achieve these objectives a one-piece barrel has been developed which is axially perforated. This single part is connected to the butt by means of some special parts which are connected to the lower portion of the barrel, with screws going through these parts. The parts in question are equipped with protruding upper ends in the form of a dovetail, which are connected in turn to the corresponding inlets in the barrel.

The back part of the barrel has a series of specific elements.

A back frontal opening in which a threaded bolt is included in the threaded inside of the said opening. This bolt can be actuated from outside and in its inside it receives the impulsion spring of the striker, this striker moving through the hollow inside of the barrel.

A lower opening, recessed in the lower part of the barrel, by means of which the firing and retaining mechanisms penetrate to the said interior in order to retain the striker.

A lateral slot through which a rod of a bolt lever passes, which lever is connected with the striker in order to retract the latter when loading the weapon.

A blind perforation, transverse to the lateral opening described above, for purpose of receiving the rod of the bolt lever.

A wide port made in the barrel near the firing chamber, which takes an angle space greater than 90 degrees upward and receives a plug that can be turned.

An opening below the forward port for the escape of gases from the firing chamber, which opening is in communication with a channel made in the butt which accedes to the outside below, according to the position of the weapon.

Through the inside of the barrel passes the striker, which presents a substantially cylindrical exterior form, with a protrusion in the front which strikes the primer arranged on a nipple in the firing chamber.

This striker is equipped with a blind inlet for reception of a spring which rests on the back bolt of the barrel. In front of this inlet, the striker is crossed by a passing perforation of circular section, which is attached with the bottom of the aforesaid blind inlet through a circular centered channel. This channel receives an auxiliary part finished from the side of the bolt through a prominence on which rests a second spring concentric with the previously cited one, which in turn rests on the bolt.

The other end of the auxiliary part extends as far as the passing transverse perforation tightened by the second spring, a hemispherical protrusion standing out from that end.

This passing perforation receives the rod of the bolt lever and it is controlled by the hemispherical protrusion which meets, held by the spring, a ring protrusion from that rod for the exact location of same.

The rod of the bolt lever being introduced into the transverse channel or perforation of the striker, it is drawn from the lever backward to compress to the springs in order to produce the impact of the said striker in combination, as will be seen later, with the retention of the lower mechanisms.

When the lever is totally retracted with the springs compressed, it is feasible to provide a safety position to the striker, since it is possible to penetrate the rod of the said lever as far as the blind lateral perforation of the barrel, which is executed near the opening through which the bolt lever runs. In this way, the first function of safety is achieved, since when the striker is loaded, it cannot be displaced. Also, this position is assured by the action of the hemispheric protrusion of the auxiliary part, with its spring, against the ring protrusion from the rod of the bolt lever.

The striker is controlled and fastened, also, by a part or sear which comes from the lower mechanisms, a sear which penetrates into a lower hollow space in the striker through an opening previously noted in the barrel itself.

In front of those positions, the barrel has an open port, which is located exactly at the firing chamber. This port receives a trigger guard by way of a plug, which is housed by its laterals in inlets in the said port. When the impulsion of the striker is undertaken, the guard is manually turned by means of a flap which is equipped for the purpose of closing the port. In order to permit the escape of gases, this portion of the barrel is also equipped with a lower port or opening through which the gases can issue to the outside, which in turn is in communication with a channel of the butt.

The firing mechanism, that is the mechanism which retains the striker under tension and is retracted in order for it to strike the primer, is disposed within into the interior of a U-shaped support which is secured with screws to the lower part of the tube exactly under one of the openings, specifically the lower opening, in order that the sear may cross that opening so that a tooth of this sear lodges in the lower inlet of the striker.

The most outstanding particular of this mechanism is the fact that when the striker is retracted when acting on it by means of the bolt lever so that the tooth of the sear device enters into the lower notch of the said striker, the assembly of the mechanism enters into a safety position. In this position the tooth of the sear is not whisked away and the striker is retained so that firing does not take place.

For this purpose, activation of another part or safety which is included inside the U-shaped brace and which extends outside by a lateral of the said brace becomes necessary. This projection has two positions and once the mechanism is assembled activation of this projection becomes necessary in order for the firing to take place.

This mechanism is comprised of four pieces, three of them separated and the fourth one on the edge of one of those. The three pieces are the sear, the trigger and the safety. The sear is the one that in turning remains connected with the other two pieces. With the trigger, due to an opening in the hooking device which receives the upper end of the trigger built by way of a notch and with the safety part by means of a point below the sear which makes contact in its turning with an upper prominence of the said safety part.

The safety is equipped with the upper projection previously noted and with a lower projection or tail which extends outside the weapon and which is the part activated from outside. At the same time, the safety bears a lateral serration in contact with a spring which marks the two positions of the part when the tail is acted on, a spring which on the other side is also connected with a lower front end of the sear. The spring is mounted on an internal catch of the support of the mechanisms.

The safety also includes a central lower zone in which a supplement is housed. secured in turning in the lower zone by means of a bolt mounted in the safety. The turning o this supplement is limited inside the walls which comprise the lowered zone and at the same time it is activated by a spring housed in an opening of the safety itself. The free end of the supplement is directed toward a projection of the trigger.

The trigger is equipped with an upper notch which is housed in an opening of the sear and a projection near the sear. Its side opposite to that of the sear's position and the safety receives the pressure of a spring housed in the support of the mechanisms and against the sear itself.

As has been previously recorded, when the striker is retracted and its rear springs are compressed against the rear bolt, the notch of the sear remains housed in the lower opening of the striker and it keeps it immobile. In turn the striker is also held by the trigger, so that as long as this trigger does not turn, the striker is held.

The turn of the trigger for release of the sear can be done or not in function of the position which the safety part provides. Thus, if this part is turned into one of its two end positions, the trigger can turn, and on the contrary if the safety part is in the other position the trigger will not be able to turn.

Acting from outside the tail of the safety part toward the right, it turns and the spring which contacts the safety and the sear enters into one of the two notch-openings. At the same time, the supplement housed in the safety is held by the lower spring housed in the safety against the upper wall of the lowered zone of the safety itself, so that the free end of the supplement remains almost in contact with the lower projection of the trigger, keeping the trigger from turning. This is the Safety position.

If the tail of the safety is turned to the left, the sear-safety enters into another of the notch-openings of this safety part and fastens it. In this turning the upper wall of the lowered zone of the safety holds the supplemental safety down so as to release its approach to the trigger, permitting the trigger to turn when activated by the user. In this turning, the upper notch of the trigger releases its entry into the sear and the latter is released, upon which the striker can move to the primer.

A warning is necessary that in this operation, the safety part was in Firing position and that when the turn of the sear is made, the lower catch of the sear strikes the upper projection of the safety and the latter begins to turn toward the Safety position, including in its turn the supplementary part. At the same time, the spring, together with the sear-safety acts against the notch of the sear, which turns again toward the striker, meanwhile the trigger does so also with its own spring until the whole assembly returns to its Safety position.

The two safeties of the rifle to which this specification refers are therefore defined, one of them the manual one by means of the bolt lever itself and the other the automatic one by holding back the striker by means of the firing mechanism.

BRIEF DESCRIPTION OF THE DRAWINGS

In the pages of accompanying diagrams, a group of mechanisms can be observed in a practical solution covered by the invention and thus, the following is represented.

DESCRIPTION OF PREFERRED EMBODIMENTS

Figure 1:
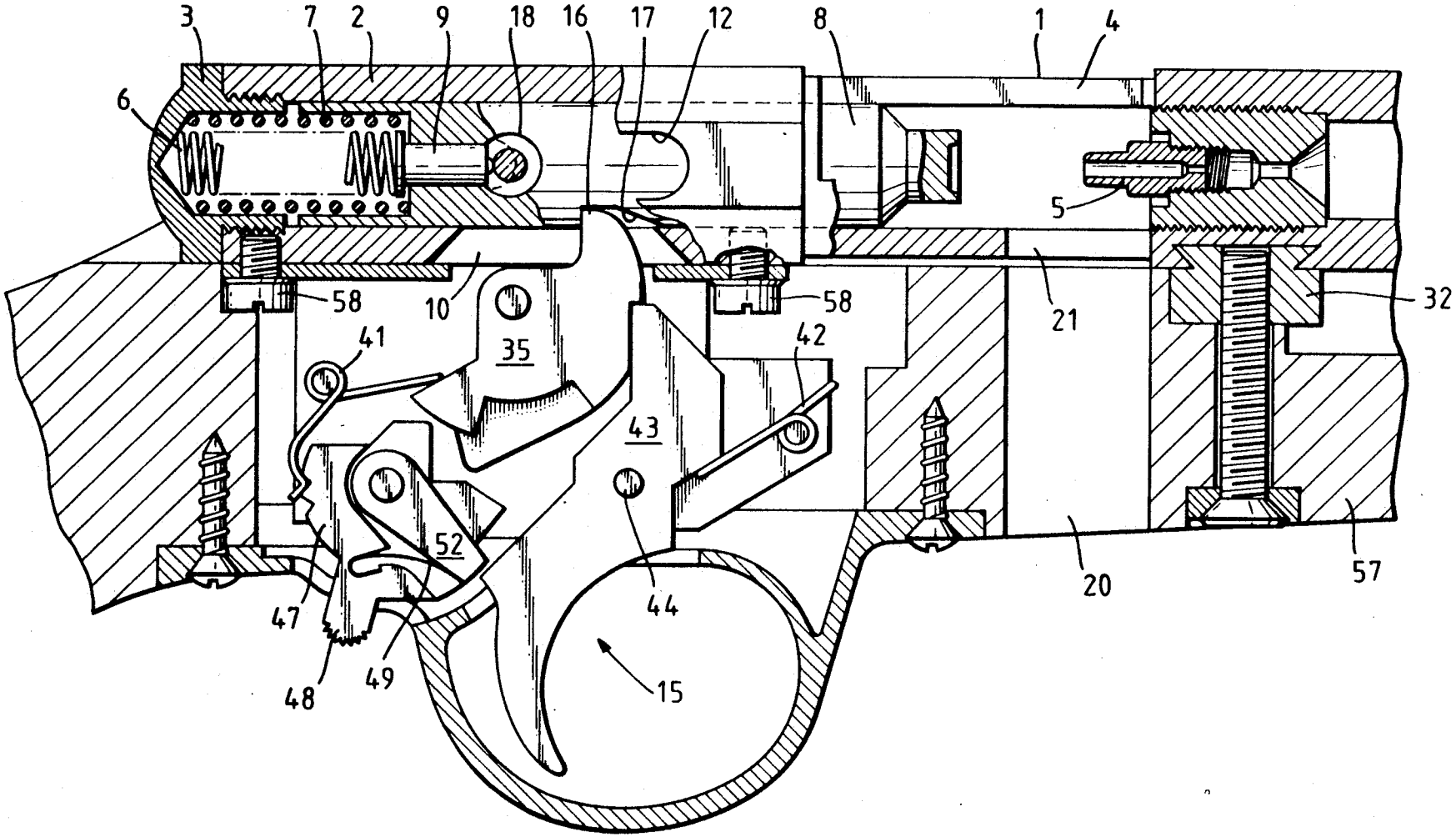
FIG. 1 is an elevation in section of the rear portion of the rifle and part of the butt.

In accordance with FIG. 1, we observe the barrel (1) and its rear portion (2), the barrel being constructed in a single piece. This figure shows the rifle placed in Safety position by the bearer. Inside of (2) we perceive the striker (8) the front end of which is projecting toward the firing chamber to strike on the nipple (5) once the latter receives the primer. This chamber is equipped with a wide lateral port (4) and a lower outlet (21) for the escape of gases toward the butt (57) through the channel (20) in the latter.

The assembly of the back part of the barrel (1)-(2) is, as we said, a single piece and there is attached to it the support of the lower trigger by means of screws (58). The fastening of the butt (57) is executed by the parts (32) and corresponding screws which are lodged in appropriate openings in the barrel.

The part of the barrel is closed by the bolt (3) which is threaded to the interior of the barrel and serves as a seating for a spring (7) supported on its other end in a housing of the striker (8). In the bottom of this lodging of the striker we see the auxiliary part (9) which on one hand receives the spring (6) concentric with the spring (7) supported in its circular end; on the other end, this auxiliary part shows a hemispheric projection which accedes to a transverse channel or perforation (18) of the striker. Below the striker the opening (10) can be observed through which the tooth (16) of the sear (35) is raised, and behind, the opening (12) for passage and circulation of the bolt lever. The tooth (16) is received into the lower opening (17) of the striker (8).

The assembly (15) of the firing mechanism, is comprised of the sear (35), trigger (43), safety (47), supplement to the safety (52), as well as the springs (41), (42) and (49), in this view the tail or projection (48) of the safety being seen to project outside for its activation. The different parts are arranged on pivot pins, for example (44) and on the supporting walls.

Figure 2:
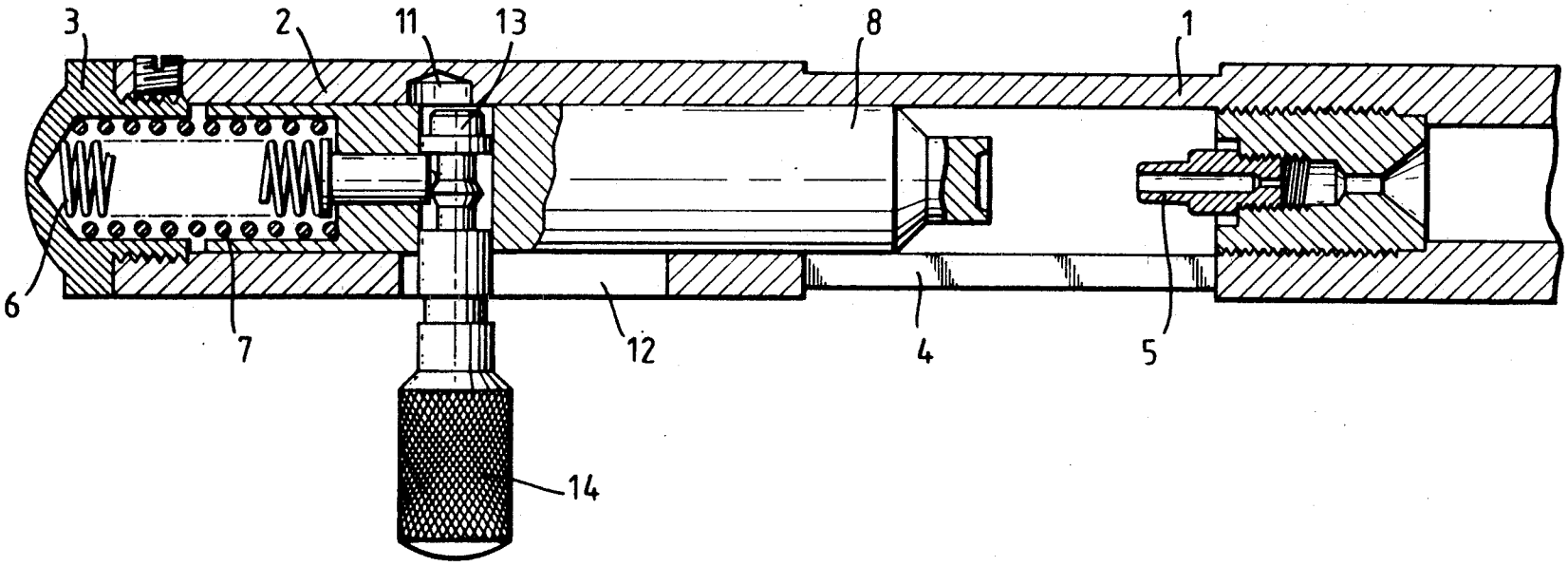
FIG. 2 is a top view of the rear portion of the rifle, without the butt.

From FIG. 2 we note that the plug (3) which closes the portion (2) of the barrel, as well as the bolt lever (14) which crosses the lateral opening (12) of the barrel until it penetrates with its rod (13) in the transverse perforation of the striker (8). In accordance with the position of the figure, the striker (8) is not totally withdrawn in relation to the opening (12).

Thus when the rod (13) reaches the left end it remains in alignment with the blind perforation (11) and can be pushed to the bottom of (11) to comprise a manual firing safety. The auxiliary piece (9) and its spring (6) press the rod (13) for its stability in any position of the said rod.

The spring (6), besides this function, acts with the other spring (7) in order to provide sufficient energy to impel the striker (8).

Figure 3:
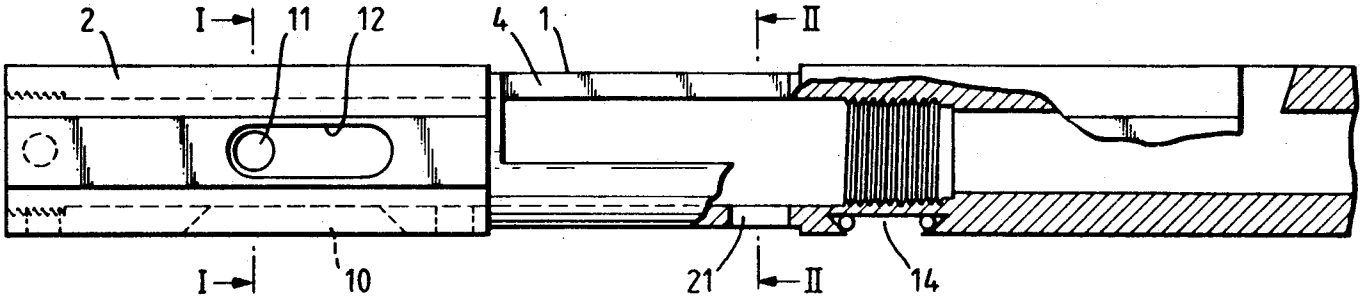
FIGS. 3 and 4 refer to the two views of the barrel, elevation and upper view.
Figure 4:
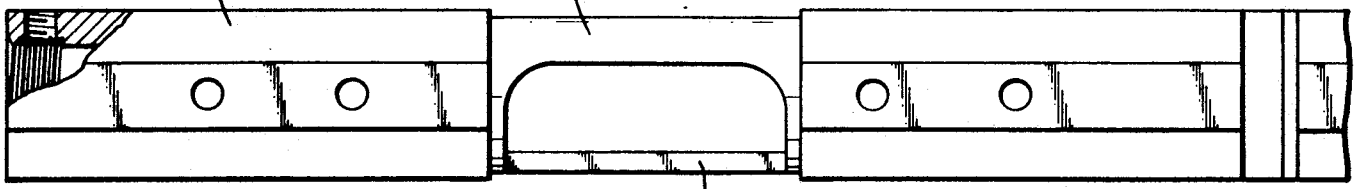

In FIGS. 3 and 4, we observe the barrel and in it and with greater detail the channel (21), opening (12), port (10) and blind perforation (11) set into the body of the barrel, as well as the opening (4) of the firing chamber and the special opening (14) for fastening the barrel to the butt.

Figure 5:
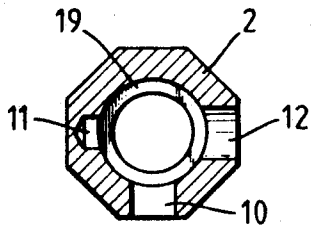
FIG. 5 corresponds to Section I—I of FIG. 3.
Figure 6:
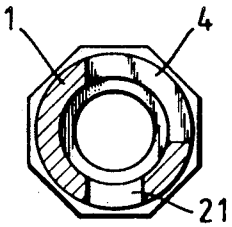
FIG. 6 is the Section II—II of FIG. 3.

Sections I—I and II—II of FIG. 3, FIG. 5 and 6, allow us to note exactly the position of these slots (10) and (4), port (12), channel (21) and blind perforation (11).

Figure 7:
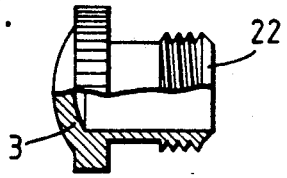
FIG. 7 represents the locking bolt of the barrel.
Figure 8:
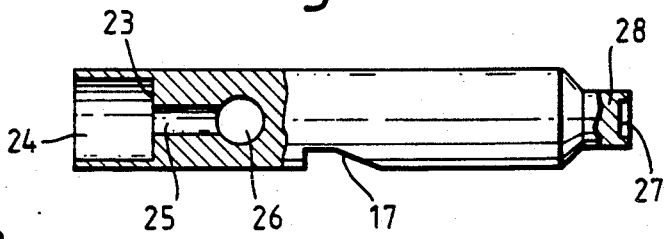
FIG. 8 shows the striker.

The back bolt (3) on which the springs (6) and (7) rest which act upon the striker (8) are represented in FIG. 7, with its portion (22) which is housed in the barrel, all of this in counterposition with the inlet (24) of the striker (8) (FIG. 8) in which the other ends of the springs (6) and (7) are received. From the bottom (23) of the portion (24) is seen the passage (25) for the auxiliary part (9) in the direction of the transverse channel or perforation (18). As the striker is guided in its course by the combination of the bolt lever in the lateral opening (12), nothing more is needed than the entry (17) for the tooth of the sear which holds the striker loaded. The forward portion (27)-(28) of the striker is what will strike against the primer.

Figure 9:
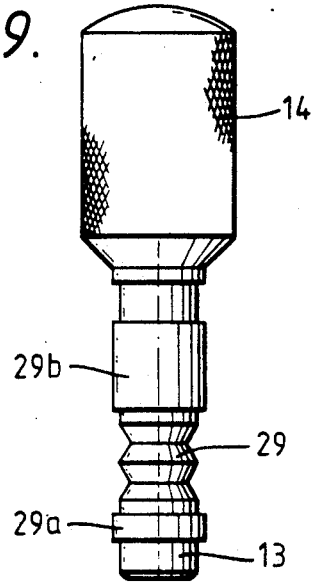
FIG. 9 is the loading lever of the rifle.

The bolt lever (14) (FIGS. 2 and 9) shows a handle broad enough for handling it and an end (13) of the rod which can be set into the internal perforation (11) of the barrel. Also, it has a centered projection (29) in which the hemispherical projection of the auxiliary part (9) can slide from one face to the other of the said projection (29), to have it enter into (11) or not. Once the auxiliary part (9) is set in, which protrudes toward the hole (26) in the striker, the lever cannot be extracted because the checks (**29*a*) and (29*b*) are established, which make contact with the part (9**).

Figure 10:
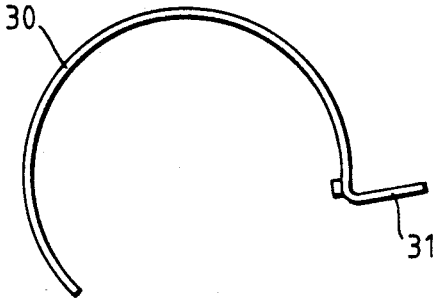
FIG. 10 is an elevation of the trigger guard.
Figure 11:
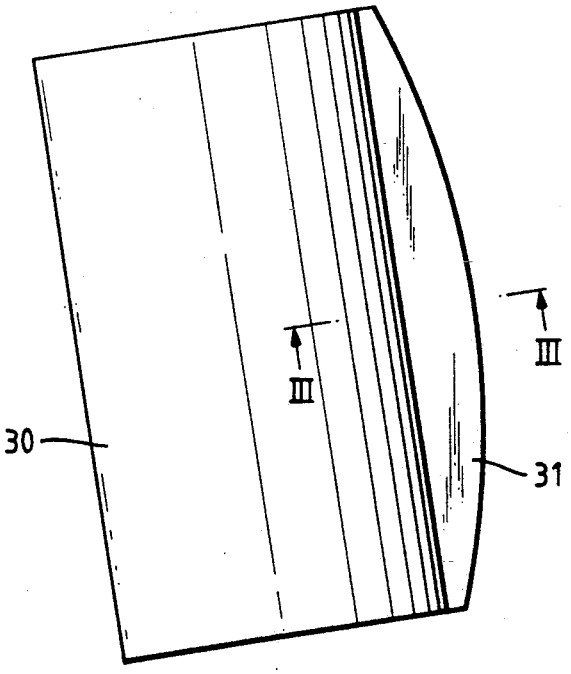
FIG. 11 is a diagram of the guard.
Figure 12:
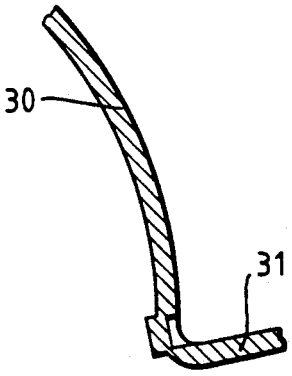
FIG. 12 corresponds to section III—III of FIG. 11.
Figure 13:
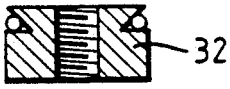
FIGS. 13 and 14 are an elevation in section and a lateral view of the connecting parts between the barrel and the butt.
Figure 14:
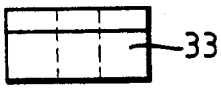

In FIGS. 10, 11 and 12 we observe the plug or trigger guard which closes the opening (4) in the firing chamber (4) to avoid the discharge of gases toward the shooter. This guard (30) is placed inside the firing chamber in such a way as to fit it walls and it is equipped on one end with a projection (31) in the form of a button. The guard makes an angle of approximately 120@ as can be seen in FIG. 10 and broadly closes the opening (4) of the barrel (FIG. 6).

When guard (30) is locked, the projection (31) remains placed on the horizontal end of same, and when guard 30 is opened, projection (31) makes contact with the vertical end of the opening. When the guard (30) closes the firing chamber, the lower channel (21) remains open, and when the chamber is open the guard (30) closes that channel.

In FIGS. 1, 3, 13 and 14, the part appears which connects the lower portion (14) of the barrel with the butt. This part (32) with its upper end dovetailed, is placed in the corresponding entry (14) of the barrel in such a way that by means of the reception of the corresponding screw it serves as a nexus of union for the butt. In view of the special configuration of the part (32) and its seating in the barrel, this assembly makes it possible to support the recoil of the weapon perfectly.

Figure 15:
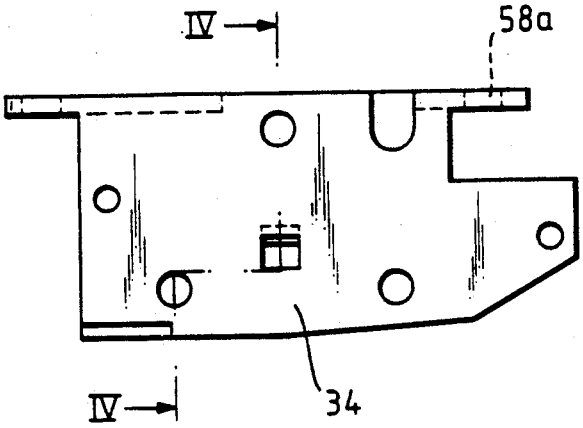
FIG. 15 is an elevation of the trigger support.
Figure 16:
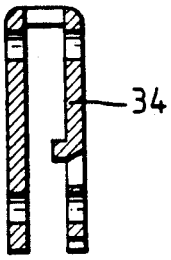
FIG. 16 is the section IV—IV of FIG. 15.
Figure 17:
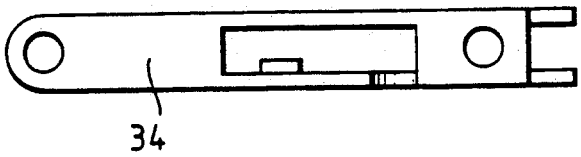
FIG. 17 is the view from above of FIG. 15.

In FIGS. 15, 16 and 17 we observe the special arrangement of the support (34) of the trigger in the interior of which are placed the sear, safeties trigger . . . etc., parts, which is fastened by the holes (**58*a*) to the barrel. This part (34) is equipped with a series of other holes in which pivot pins are placed to receive the aforesaid parts and the recovery springs shown in FIG. 1**.

Figure 18:
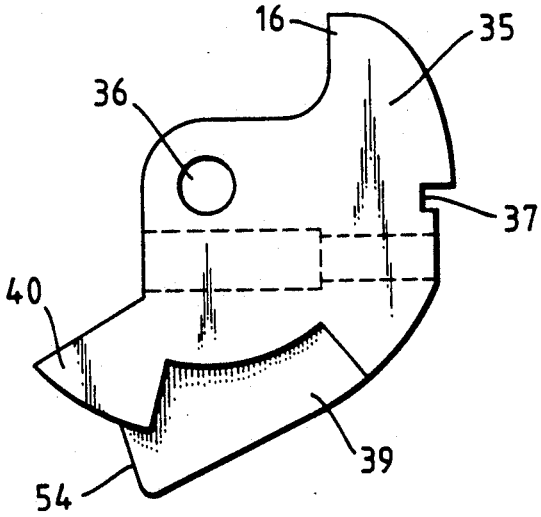
FIG. 18 shows the elevation of the sear part.
Figure 19:
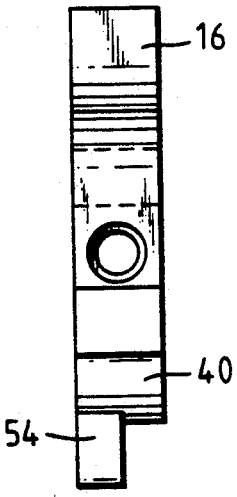
FIG. 19 corresponds to the view from the left of FIG. 18.

The sear (35) is shown in FIGS. 18 and 19 with its turning point (36), upper notch (16) for connection with the striker (8) and inlet (37) to receive the upper end of the trigger. In its lower zone is established the portion (39) rounded out by the point (54). Another portion (40) of the sear serves as support for one of the arms of the spring (41).

Figure 20:
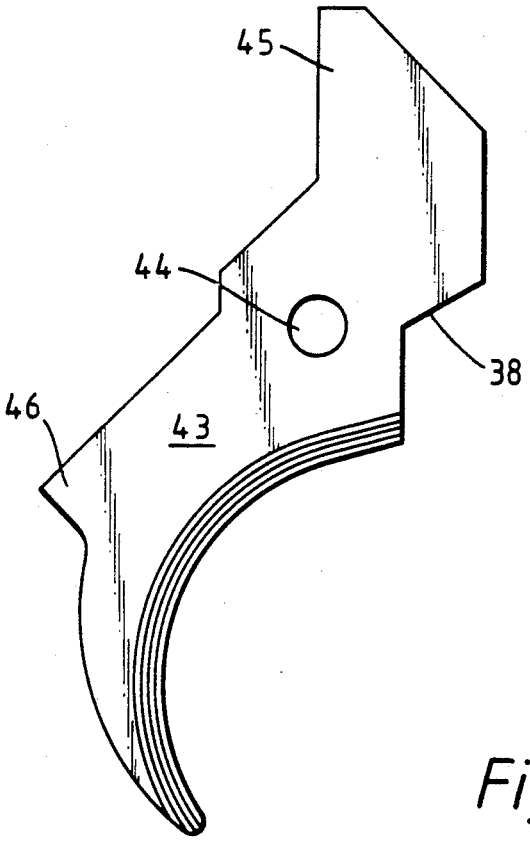
FIG. 20 shows the trigger.

In FIG. 20 we observe the trigger (43) which turns on (44); the upper area (45) fits into the inlet (37) of the sear, the portion (38) receives the action of the spring (42) and the lower end (46) remains positioned toward the supplemental safety or part (52).

Figure 21:
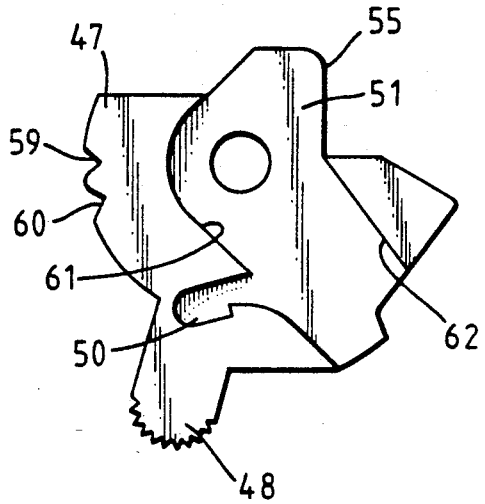
FIG. 21 is a diagram of the safety part.
Figure 22:
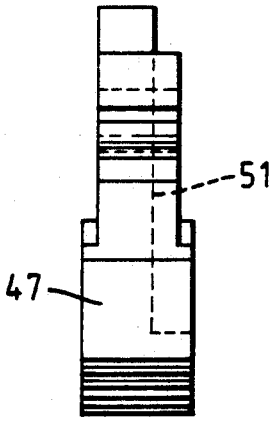
FIG. 22 is a left-hand view of the foregoing one.
Figure 23:
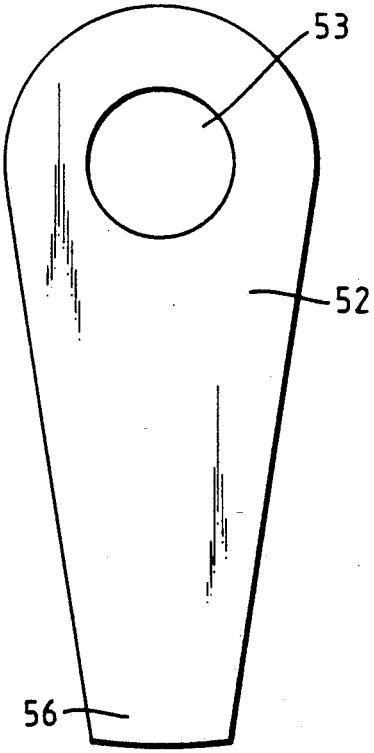
FIGS. 23 and 24 show the supplementary safety
Figure 24:
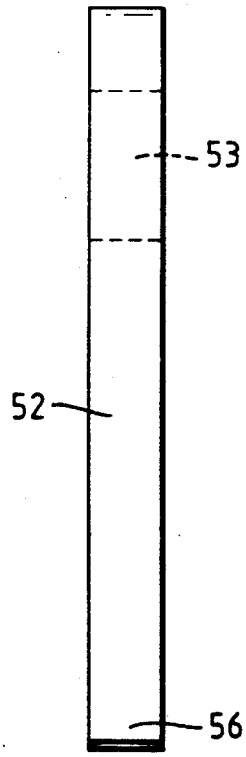

The safety (47) is shown in FIGS. 21 and 22 and is comprised of an upward projection with a side wall (55) with a lowered central zone (51) which is located between two walls (61) and (62) which converge in the direction of the trigger. The wall (61) has an inlet (50) to hold a spring. In the left side of the safety are observed the inlets (59) and (60) which alternatively receive the end of the latch spring (41).

The part (52) or supplemental safety, is set into the indented portion (51) of the safety and between the walls (61) and (62), with its end (56) toward the trigger.

Figure 25:
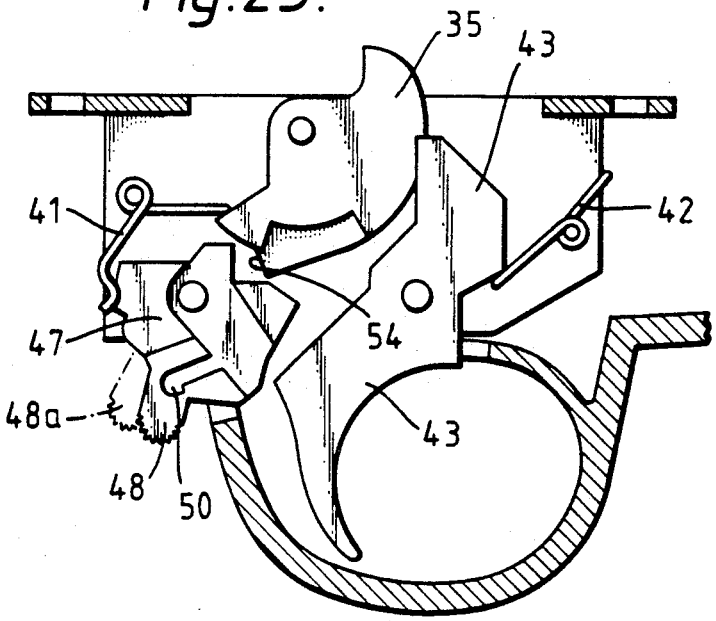
FIG. 25 reflects the position of the parts of the trigger, in which, for purposes of clarity, the supplementary safety part has been eliminated.
Figure 26:
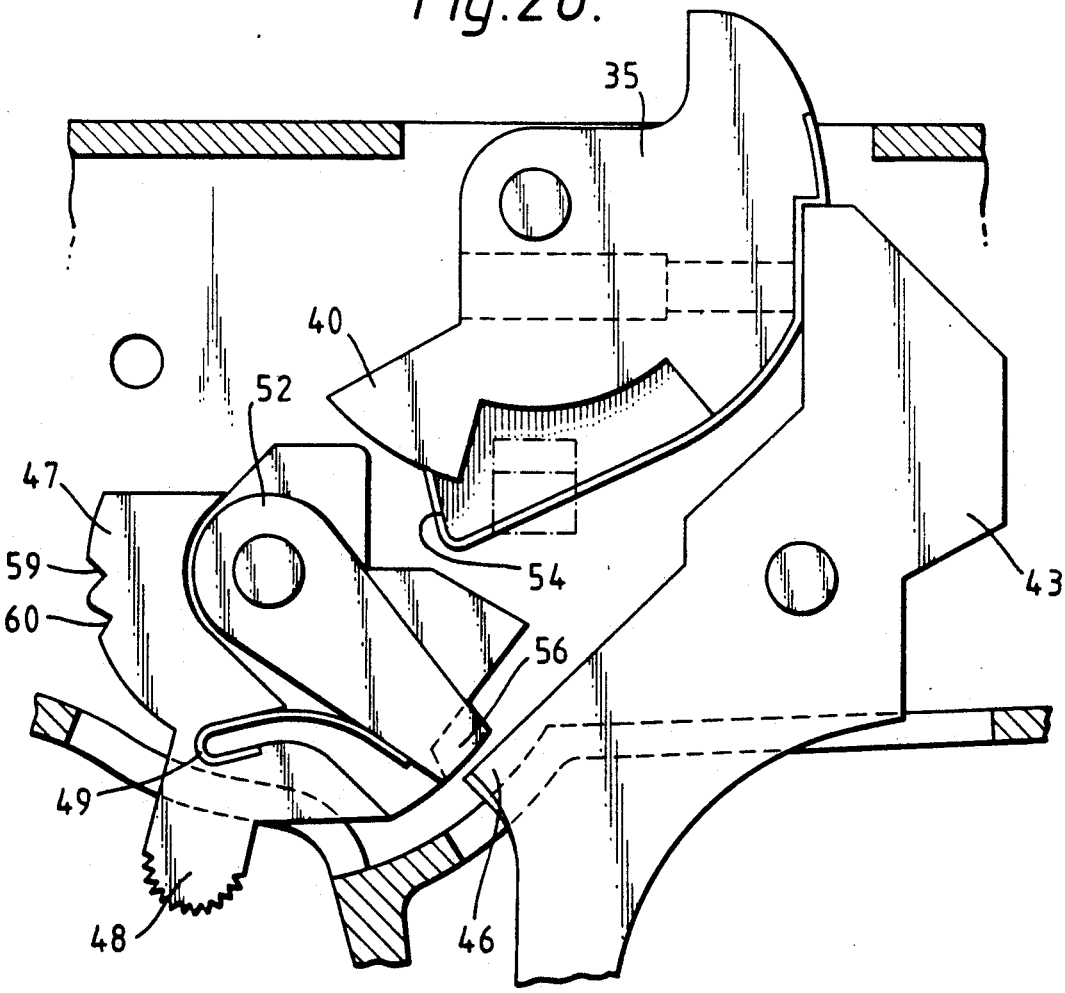
FIG. 26 shows the position of the parts of the trigger in safety mode.

In FIG. 25 the conjunction of all the parts of the firing device are shown without drawing the supplemental safety part, for purposes of comparison with FIG. 26 in which it is indeed drawn. Since in the two figures the position of the parts corresponds to the Safety position, the difference between the two will be noticed at first glance, since as in FIG. 25, the trigger (43) can be moved toward the safety (47) in FIG. 26 when the trigger moves, the end (46) of it makes immediate contact with the end (56) of the supplemental one.

In FIG. 26 the safety part (47) is positioned in the same way as in FIG. 1, with the tail (28) turned to the right so that the arm of the spring (41) remains contained in the upper inlet (59), so that the supplemental one (52) held by the spring (49) remains with its end (56) very close to the point (46) of the trigger (43), so that the trigger has no movement and cannot unfasten its connection with the sear (35). Consequently the shot cannot be fired.

Figure 27:
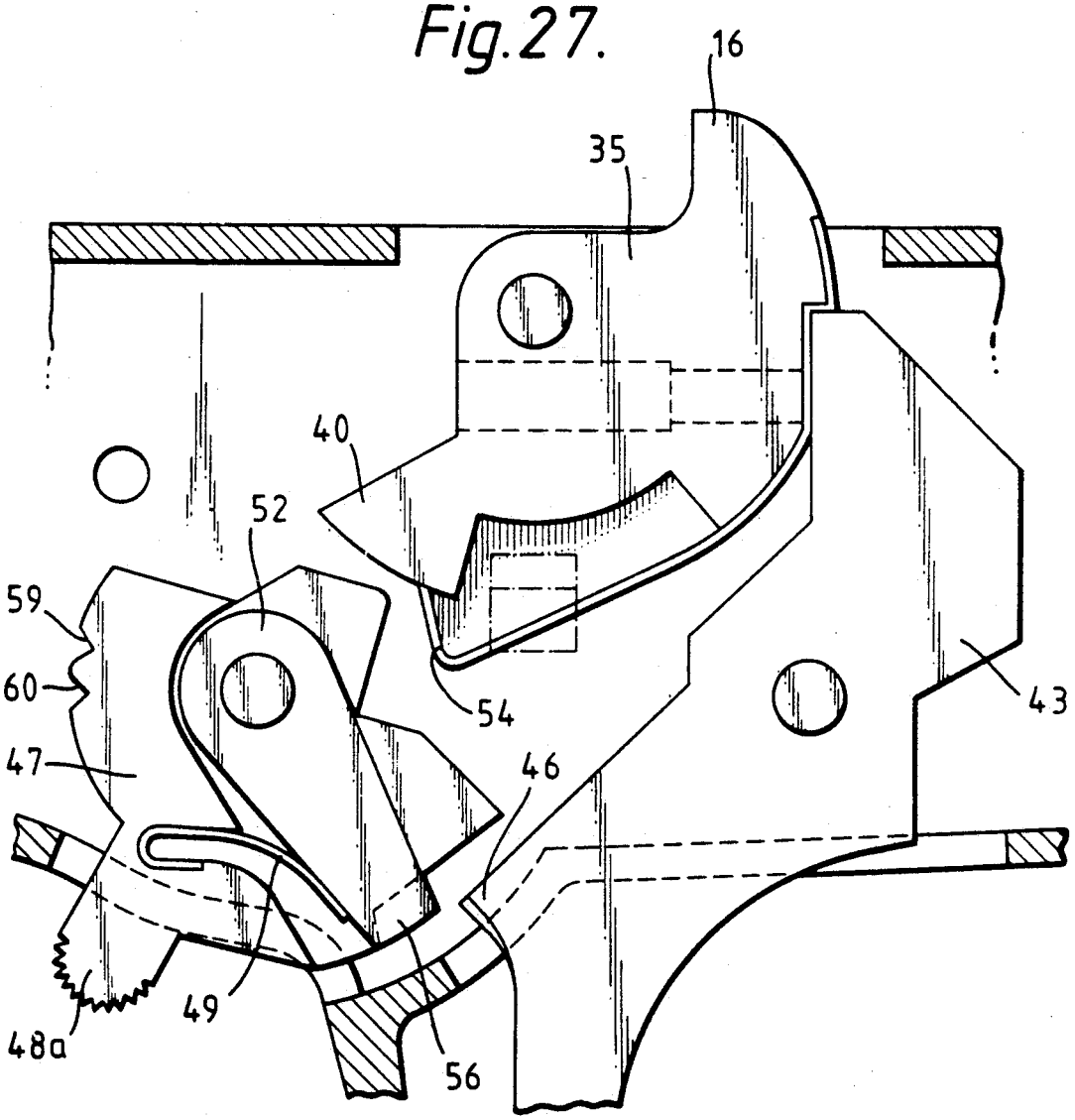
FIG. 27 represents the mechanisms with the safety activated from outside at the Firing position.

For that to be possible, it is necessary to act on the tail (48) toward the left as far as the position (48*a*), FIG. 27, whereby the safety (47) turns and with it the supplemental one (52), the end of which sets free the point (46) so that the trigger can turn. In this position, the spring (41) has switched to occupying the lower lateral inlet (60) and the trigger will free the sear (35) which is turned by the striker (8).

Figure 28:
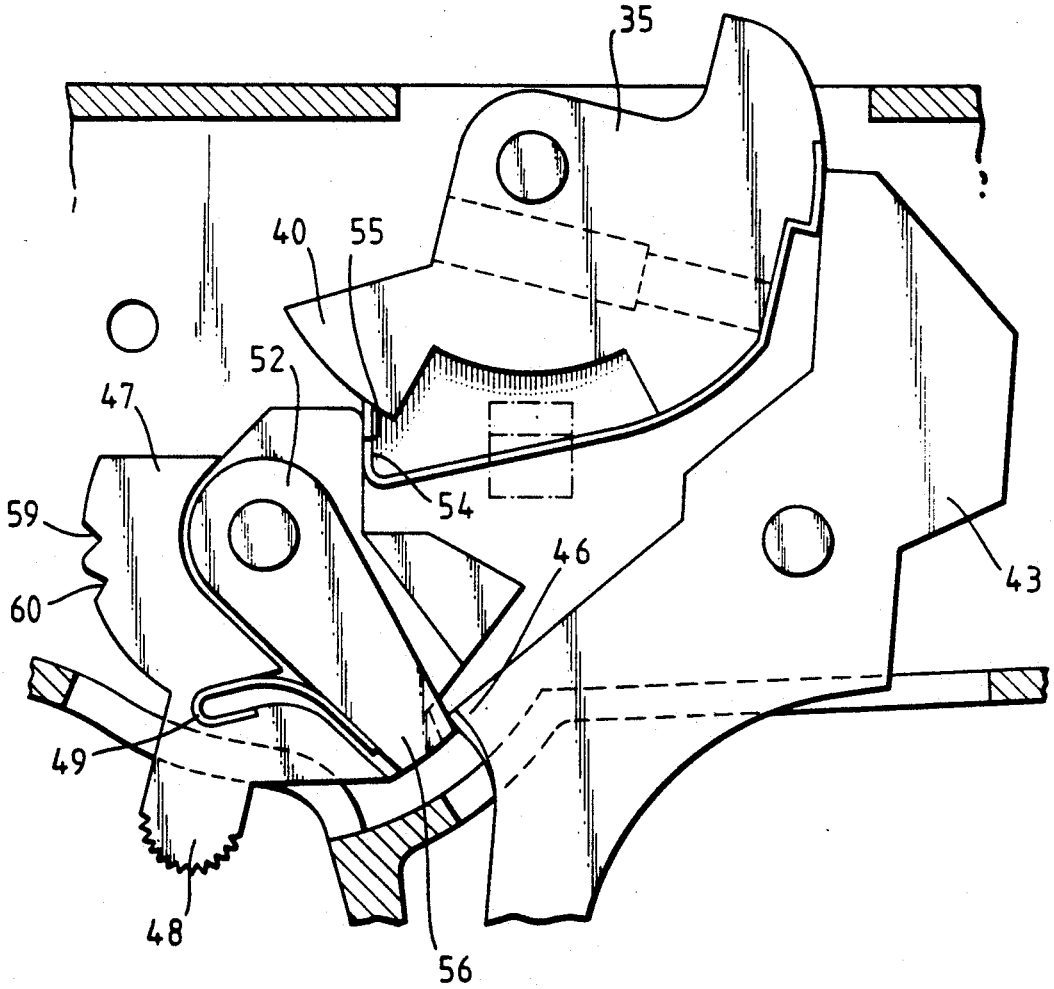
FIG. 28 shows the mechanisms once the discharge has been produced and before its total rearming.

When turned (48), the position corresponds with that of FIG. 28 in which the trigger (43) has released the connection with the sear (35) and the latter is turning. In this turn, the point (54) of the sear strikes the point (55) of the safety (47) and the latter begins to turn toward the safety position, the spring (49) acts on the supplemental, and the trigger turns in the direction to take out the point (46) downward, whereby when we withdraw the striker (8) all of the assembly turns to its initial position of safety, FIG. 26, and the sequence is repeated.

It is well to emphasize, once the nature and advantages of this invention are described, the non-limiting nature of same, as changes in form, material or dimensions of the parts comprising it will not in any way alter its essential nature, unless there should be a substantial variation in the assembly.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A rifle comprised of a support area of the barrel and a retaining and safety mechanism connected with a striker which moves through the inside of the rear portion of the barrel, wherein, the barrel is a single piece in its whole length and is directly connected with a butt and front part thereof in which barrel, from its most recessed end is equipped with a threaded end opening recessed internally which receives a threaded plug in which concentric springs of the striker rest; a lower longitudinal opening for the passage of a tooth projecting from a sear piece of the retaining and safety mechanism in its connection with the striker; an internal horizontal blind perforation of circular section executed according to a medium plane of the barrel, which accedes through its diametrical end to the inside of the barrel through a longitudinal slot; a longitudinal opening toward the front of said longitudinal slot which occupies a section greater than 90 degrees made above a medium longitudinal plane of the barrel; a lower port below the front end of said longitudinal opening near the position of a primer.

2. A rifle according to claim 1, wherein, in the longitudinal opening larger than 90 degrees of the barrel there is located a cover of a circular component equipped with a flap for respective closing of said cover and said opening at the time of firing the rifle.

3. A rifle according to claim 1, wherein, the port of the barrel under the opening greater than 90 degrees, is in communication with a perforation in the base of the barrel and from there communicating with the outside through a channel in the butt.

4. A rifle comprised of a barrel, a support area of the barrel and a retaining and safety mechanism connected with a striker which moves through the interior of a rear portion of the barrel wherein, the striker is equipped with a rear longitudinal casing in which is arranged a spring which rests on a back bolt of the barrel, a transverse perforation to place a bolt lever, a lower projection for connection with a tooth of a sear piece of the retaining and safety mechanism, and a forward projection to strike against a primer, wherein, between the back bolt and the transverse perforation the striker has a longitudinal channel which communicates to both of them, in which channel an auxiliary part is set with a rear circular raised base, a cylindrical portion and an end equipped with a spherical protrusion which accedes towards the transverse perforation, in which, on the circular raised base there is supported a spring which in turn rests on the back bolt of the barrel and is concentric with the other spring.

5. A rifle according to claim 4, wherein, a longitudinal bolt lever crosses the barrel laterally and the transverse perforation of the striker by means of a longitudinal slot, in which the body of this lever is controlled by the protuberance with the spherical protrusion, presenting an outside head possible to operate to make it penetrate or take out the body to place it in or extract it from the bottom of a horizontal blind perforation near the slot.

6. A rifle comprised of a barrel, a support zone of the barrel and a retaining and safety mechanism a striker which moves through the inside of a rear portion of the barrel, wherein, the retaining and safety mechanism is placed inside of a support equipped with two opposing faces, from which there protrudes an upper tooth of a sear piece which is connected with a striker, in which the sear is equipped with a lateral inlet into which one upper end of a trigger is introduced, a third part or safety existing which, like the other two, turns on pins placed in the support, in which the three parts are controlled by two springs set in the support, in which a safety has a tail below which extends outside, a projection upward capable of making contact with a lower point of the sear, and a central insert portion of lateral faces on an angle, in which portion a supplement of the safety is housed which turns on the same pin as the said safety and is controlled by a spring mounted on the safety and by the above mentioned lateral faces, which is a function of a position of the safety does or does not contact a lower projection of the trigger.

7. A rifle according to claim 6, wherein, when the striker is cocked, the lower point of the sear makes contact with the upper projection of the safety making the safety turn toward a safety position, in which the end of the supplement of the safety remains facing the trigger and by the fact that two springs, one of them with two arms, are located on a notch of the sear and on one or the other of the lateral inlets of the safety, while the other one is the one for cocking the trigger.

8. A rifle comprising a barrel;

a striker having a forward projection movable in said barrel to strike against a nipple;

a support area of the barrel at a rear portion of said barrel;

a retaining and safety mechanism connected with said striker which moves into the interior of said rear portion of said barrel and includes a sear piece;

said striker having a transverse perforation therethrough, a lower opening and including a rear longitudinal casing;

two springs resting against a back bolt of said barrel and arranged to extend into said rear longitudinal casing;

a retaining and safety lever extending through said transverse perforation;

said sear piece having a tooth positioned to extend into said lower opening of said striker.

* * * * *